US005240181A

United States Patent [19]

Uribe

[11] Patent Number: 5,240,181

[45] Date of Patent: Aug. 31, 1993

[54] HIGH VOLUME, LOW PRESSURE PAINT SPRAYING SYSTEM

[76] Inventor: Armando R. Uribe, 11744 Hatteras St., North Hollywood, Calif. 91607

[21] Appl. No.: 871,354

[22] Filed: Apr. 20, 1992

[51] Int. Cl.[5] ..... B05B 1/24; B05B 7/24

[52] U.S. Cl. ..... 239/135; 239/290; 239/302

[58] Field of Search ..... 239/290, 302, 135; 137/895

[56] References Cited

U.S. PATENT DOCUMENTS

| | | | |
|---|---|---|---|
| 1,311,839 | 7/1919 | Paasche | 239/135 |
| 2,148,986 | 2/1939 | Hoyt | 239/135 X |
| 3,336,463 | 8/1967 | Johnson | 239/135 X |
| 4,132,357 | 1/1979 | Blackinton | 239/290 X |
| 4,850,809 | 7/1989 | Smith | 417/76 |
| 4,915,303 | 4/1990 | Hufgard | 239/290 X |
| 4,991,776 | 2/1991 | Smith | 239/302 |
| 5,044,557 | 9/1991 | Smith | 239/302 |
| 5,058,807 | 10/1991 | Smith | 239/302 |
| 5,090,895 | 2/1992 | Jensen et al. | 239/135 X |

*Primary Examiner*—Andres Kashnikow
*Assistant Examiner*—Lesley D. Morris
*Attorney, Agent, or Firm*—Spensley, Horn, Jubas & Lubitz

[57] ABSTRACT

A high volume, low pressure air supply for a paint spraying system includes a primary, high pressure reservoir connected to a secondary reservoir maintained at a pressure substantially lower than the primary reservoir. The secondary reservoir is a "dedicated" unit supplying a limited number, for example two, conventional spray guns. The dedicated reservoir in combination with larger than conventional, short supply lines to the paint spray guns provides a high volume, low pressure spray system that results in substantially less "overspray" thereby conserving paint and reducing airborne pollutants. The air supply system includes an air heater downstream of the dedicated reservoir for heating air supplied thereby so as to reduce the viscosity of the paint entrained by the air stream.

3 Claims, 1 Drawing Sheet

HIGH VOLUME, LOW PRESSURE PAINT SPRAYING SYSTEM

FIELD OF THE INVENTION

The present invention relates generally to paint spraying systems and more particularly to high volume, low pressure paint spraying systems for producing an improved paint finish with minimum overspray.

BACKGROUND OF THE INVENTION

Most present day paint spraying systems, such as those employed in the refinishing of automobiles, utilize high pressure, low volume air supply systems capable of supplying many spray guns via relatively long, small diameter supply lines. Such conventional systems, however, particularly in the hands of less skillful operators, tend to produce low quality finishes including such unacceptable characteristics as "orange peel" and dry spots. These existing systems also tend to produce "overspray" which not only wastes paint but produces airborne pollutants which may violate federal, state and/or local clean air standards.

SUMMARY OF THE INVENTION

The improved high volume, low pressure spraying system of the present invention may be added to an existing high pressure, low volume system. Thus, the existing system may comprise a high pressure compressor and reservoir for supplying many individual spray guns via conventional supply lines, pressure regulators, water and oil traps and disconnects.

In the improved system, air is supplied from the existing high pressure or primary reservoir through a pressure regulator and associated water and oil traps to a secondary reservoir maintained at a pressure substantially lower than that of the primary reservoir. The secondary reservoir is a limited capacity, "dedicated", local unit typically supplying no more than a limited number of spray guns closely coupled to the dedicated reservoir. The secondary reservoir in combination with larger than conventional, short supply lines and a limited number of spray guns, provides a high volume, low pressure spraying system that results in substantially less overspray thereby improving transferability, conserving paint and reducing airborne pollutants. Also, by supplying a high volume of air at lower pressure and minimizing air flow restrictions in the lines, paint atomization is improved to produce a better paint finish, that is, one which minimizes orange peel or dry spots.

Another feature of the invention involves the incorporation of an air heater in the discharge line from the secondary or dedicated reservoir. By heating the air supplied by the secondary reservoir the viscosity of the paint entrained by the air stream is decreased thereby further contributing to a higher quality paint finish.

BRIEF DESCRIPTION OF THE DRAWINGS

Further objects, advantages and features of the present invention will become evident from the detailed description of the preferred embodiment when read in conjunction with the accompanying drawing in which.

DETAILED DESCRIPTION OF THE PREFERRED EMBODIMENT

Figure 1:
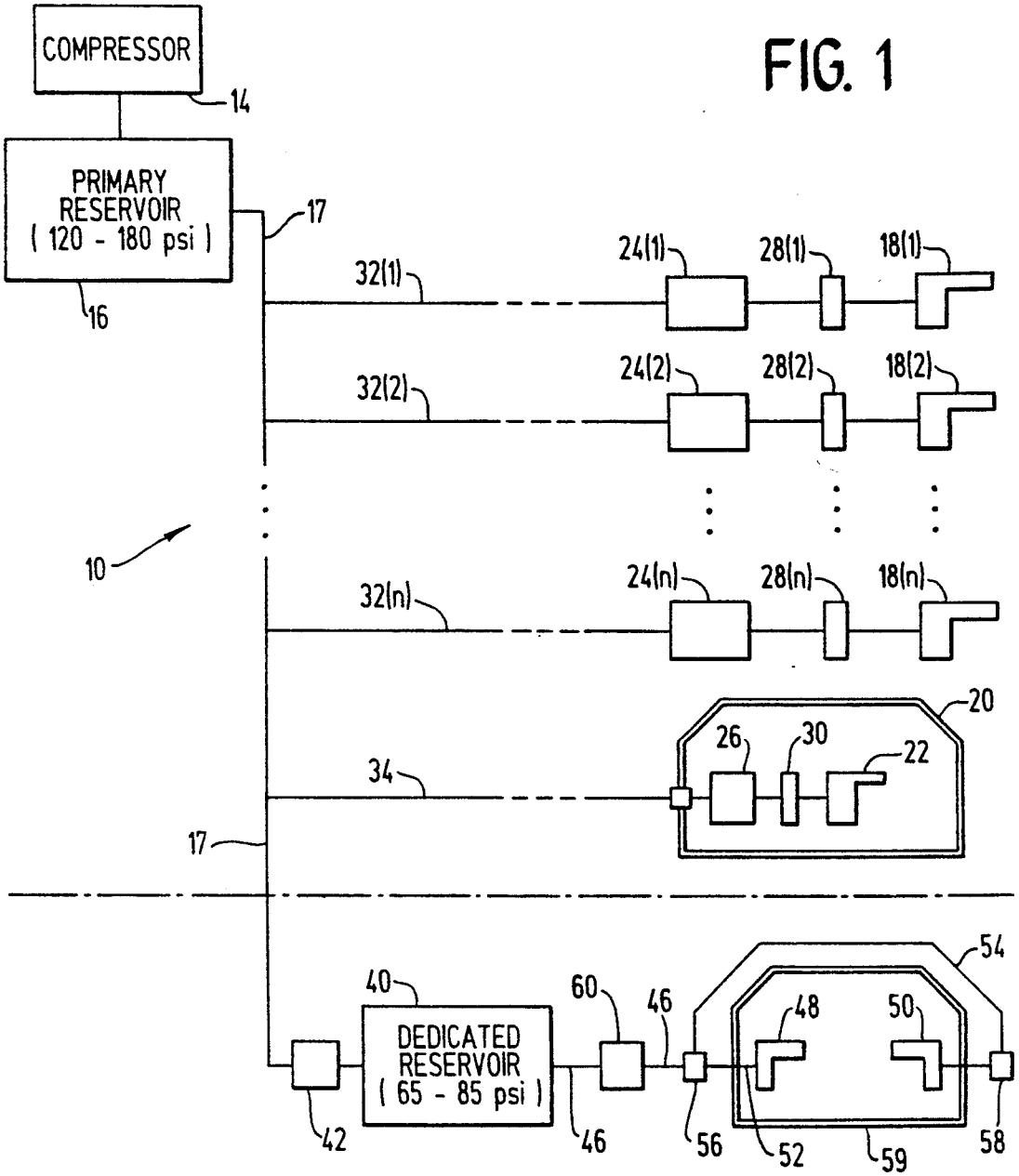
FIG. 1 shows in schematic, block diagram form an existing high pressure, low volume paint spraying system to which is coupled an improved high volume, low pressure paint spraying system in accordance with the present invention.

With reference to FIG. 1 of the drawings, there is shown a conventional high pressure, low volume paint spray system 10 to which has been connected to an improved, high volume, low pressure system 12 in accordance with the invention. The conventional system 10 includes a high pressure compressor 14 supplying a high pressure or primary reservoir 16 maintained, for example, at 120–180 psi, and typically having a capacity of 120–140 gallons. A main air supply line 17 from the high pressure reservoir 16 supplies both a plurality of spray guns **18(1)–18(*n*) and a conventional spray booth 20 having a spray gun 22. The spray guns 18(1)–18(*n*) and 22 are connected to the main supply line 17 through conventional pressure regulators 24(1)–24(*n*) and 26 and standard ¼-inch disconnects 28(1)–28(*n*) and 30. In the conventional system 10, the supply line 17 is typically a 2-inch diameter pipe feeding relatively long, individual ½-inch lines 32(1)–32(*n*) and 34 to the spray guns 18(1)-18(*n*) and spray booth 20**, respectively.

Figure 2:
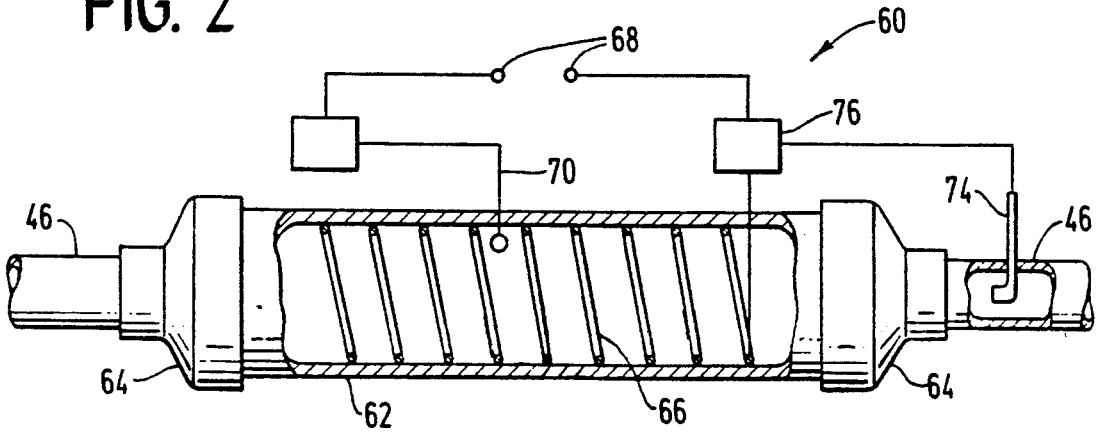
FIG. 2 is a side elevation view, partly in cross section, showing the details of an air heater that may be used in conjunction with the secondary air supply system of the present invention.

In accordance with the invention, the main supply line 17 is also connected to a low capacity, secondary or "dedicated", low pressure reservoir 40 through a pressure regulator, water trap and oil trap shown collectively as block 42. In accordance with one specific example of the invention, the pressure regulator forming part of structure 42 may maintain the dedicated reservoir at a pressure of 65–85 psi, and the capacity of the dedicated reservoir may be about 30 gallons. A single discharge line 46 from the dedicated reservoir supplies, in the example shown, a pair of spray guns 48 and 50 via individual lines 52 and 54, respectively, connected to the single discharge line 46 by means of a T-fitting 56. The air pressure in the reservoir 40 is regulated at or close to the pressure needed to produce less than ten (10) psi at the spray gun nozzles to properly atomize the paint. The discharge line 46 from the dedicated reservoir 40 as well as the individual supply lines 52 and 54 to the spray guns 48 and 50 are larger than those conventionally used. For example, instead of ½-inch lines, the discharge line 46 from the dedicated reservoir can be ¾-inch or even larger; the disconnects (such as disconnect 58 to gun 50) coupling the spray guns to their supply lines can be ⅜-inch instead of the ¼-inch. The dedicated reservoir 40 has a limited capacity and although constantly replenished from the primary reservoir, is preferably and most effectively used to supply a limited number of spray guns, for example, no more than about two to four guns. The reservoir 40 is a "local" tank in that it is mounted close to the spray guns 48 and 50. For example, if the spray guns 48 and 50 are used within a spray booth 59, the reservoir 40 may be conveniently mounted on or adjacent the exterior wall of the booth 59. As a result, the distance from the reservoir 40 to the guns 48 and 50 is no greater than about ten (10) to fifteen (15) feet in a typical installation. The combination of a local, relatively low capacity, low pressure secondary reservoir supplying a limited number of spray guns through short, oversize lines minimizes line and other losses so as to provide for a superior high volume, low pressure paint spraying system that produces high quality finishes with minimum paint waste, overspray and resulting airborne pollutants With reference now also to FIG. 2, the single discharge line 46 from the dedicated reservoir 40 incorporates therein an air heater 60 for heating the air supplied by the reservoir 40. By so heating the air, for example, to about 120°-160° F., the viscosity of the paint entrained by the air stream in the spray guns 48 and 50 is decreased thereby contributing to a high quality paint finish. The air heater comprises an enlarged diameter section of pipe 62, which may be, for example, 2 inches in diameter, coupled to the line 46 by end-bell couplers 64. Bonded or otherwise secured to the interior wall surface of the pipe 62 is a heater coil 66, of insulated resistance wire or the like, having external terminals 68 for connection to an appropriate electrical power supply (not shown). A thermostat 70 provided within the heater section 60 is connected to a power supply lead 72 to control the current to the coil 66 to limit the temperature within the heater 60 to about 120°-160° F., in accordance with one specific example. An air velocity or flow sensor 74 installed in the supply line 46 downstream of the heater section 60 senses the presence of air flow in the pipe 62 and operates to turn off the heater by means of a switch 76 when there is no flow.

The foregoing should be considered illustrative only of the principles of the invention. Further, since numerous modifications will readily occur to those skilled in the art, the invention is not to bė construed as limited to the exact construction and operation shown and described. Accordingly, all suitable modifications and equivalents are intended to be covered by and to fall within the scope of the invention as claimed.

What is claimed is:

1. A high volume, low pressure paint spraying system comprising:

a source of high pressure compressed air including an air compressor and a large capacity, high pressure air reservoir; and a dedicated, low capacity, low pressure air reservoir coupled to said high pressure reservoir via a pressure regulator and contaminant traps, said low pressure air reservoir being closely coupled to a limited number of paint spray guns by means of air supply lines and disconnects having oversized air passageways.

2. A paint spraying system, as set forth in claim 1, in which:

the oversized air supply lines include a single line from said dedicated reservoir, said single line being common to said spray guns; and said common supply line includes a heater for heating the air supplied to said spray guns.

3. A paint spraying system, as set forth in claim 2, in which:

the heater includes an enlarged diameter section of pipe in said common supply line, an electrical air heating coil within said pipe adapted to be connected to a source of electrical energy, a temperature sensor within said pipe connected to regulate the temperature of the air supplied by said heater and an air flow sensor for detecting the presence of air flow in the common supply line and coupled to disconnect the heating coil from the source of electrical energy upon detection of a no flow condition.

* * * * *